United States Patent [19]

Wagner

[11] Patent Number: 4,471,815

[45] Date of Patent: Sep. 18, 1984

[54] REED CAPSULE

[76] Inventor: Theodor Wagner, Heppstrasse 149, D-7410 Reutlingen, 11-Betzingen, Fed. Rep. of Germany

[21] Appl. No.: 382,192

[22] Filed: May 25, 1982

[30] Foreign Application Priority Data

Jun. 2, 1981 [DE] Fed. Rep. of Germany ..... 3121818

[51] Int. Cl.[3] ..... D03D 49/68

[52] U.S. Cl. ..... 139/192

[58] Field of Search ..... 139/91, 188, 191, 192

[56] References Cited

U.S. PATENT DOCUMENTS

| | | | |
|---|---|---|---|
| 990,528 | 4/1911 | Cote | 139/192 |
| 1,449,686 | 3/1923 | Mace | 139/192 |
| 2,172,972 | 9/1939 | Hall | 139/192 |
| 2,783,780 | 3/1957 | Wagner | 139/192 |

FOREIGN PATENT DOCUMENTS

| | | | |
|---|---|---|---|
| 2127209 | 2/1973 | Fed. Rep. of Germany | 139/192 |
| 536446 | 12/1955 | Italy | 139/192 |

*Primary Examiner*—Henry Jaudon

*Attorney, Agent, or Firm*—Michael J. Striker

[57] ABSTRACT

In a weaver's reed provided with two parallelly running reed dents spaced from each other by a spring, the ends of the reed dents are glued in connecting hulls. Each hull is formed of two substantially L-shaped halves each provided with an outwardly extended portion. The halves are so connected to each other than the outwardly extended portion of one half overlaps the portion of another half.

6 Claims, 9 Drawing Figures

REED CAPSULE

BACKGROUND OF THE INVENTION

The invention pertains to a textile industry in general. More particularly, the invention relates to a reed with parallel reed dents running parallel to each other and spaced by a distance defined by a spring.

Reeds of the type under consideration are known in the art. The ends of the reed dents are usually glued in connecting hulls or capsules. In mounting of the reed dents in the hulls it is important that the reed dents should be held in exact parallel position and should be maintained in the precise parallel position at the opposite sides of the weaver's reed. This problem, however has not been completely solved in conventional constructions of the type under discussion. For example, in the hull structure disclosed in DE-OS No. 21 27 209 published Feb. 8, 1973 and including two halves clamped on one another there is possibility that the parallel position of two reed dents will be disturbed during the compressing of two hull halves together. Also, the desired twisting property of the hull during the pivoting connection of the two hull halves will be effected. The division of the hull into two separate but not contacting halves of a conventional type does not improve the construction of the hull because in such a construction the twisting property of a U-shaped channel in the hull is not obtained, and since the hulls often are located in the area of the ends of the reed dents glue or adhesive material connecting the hull portions to each other can flow out from the hull portions.

SUMMARY OF THE INVENTION

It is an object of the invention to provide an improved weaver's reed capsule.

It is another object of the invention to provide a connecting hull or a capsule for a reed, in which the parallel position of the reed dents and that of the outer sides of the hull are ensured.

Still another object of the invention is to provide such a construction of the hull, in which an adhesive material does not flow out from the connected parts.

These and other objects of the invention are attained by a reed capsule with parallel reed dents spaced from each other at a distance defined by a spring, comprising a lower and an upper hulls in which the ends of the reed dents are glued in, at least the lower hull including two longitudinal halves connected to each other so as to form a channel receiving the ends of the reed dents, each of said halves including a portion, the portion of one of said halves overlapping the portion of another of said halves and being sealingly connected thereto.

According to further features of the invention each of the halves may have an L-shape cross-section, a horizontally extending projection of one half overlapping a horizontally extending projection of another half of the hull.

One portion of the hull halves may include an outwardly extending projection and the portion of another of the halves may include two outwardly extending projections spaced from each other to form a recess therebetween, said outwardly extending projection of the one portion engaging in said recess.

In accordance with further features of the invention each of the portions may be formed with a groove-like recess, the hull further including a connecting element extending between said two halves and engaged in the groove-like recesses of said portions.

The connecting element may be made out from an elastic material.

According to still further features of the invention the connecting element may be provided with two opposite enlarged end portions, the aforementioned recesses being formed with respective enlarged regions, said end portions being engaged in said enlarged regions when the connecting element is inserted into said recesses.

Due to the fact that the connecting hull or capsule is divided into two portions sealingly connected to each other in the bottom area of the hull the maintaining of the parallel position of the outer surfaces of the hull after the hull halves have been assembled to each other can be easily obtained without exercising a strong pressure. It is thereby warranted that the parallel position of the reed dents during the assembling of the hull is not changed.

Due to the overlapping position of two projections formed on the hull halves the flowing of a glue utilized for connecting the ends of the reed dents to the hull out of the connection is totally prevented. The connection of reed dents to the hull according to the invention is therefore very rigid and stable.

If a connecting bar of an elastic material is utilized as mentioned above a very reliable locking or arresting correction will be obtained.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
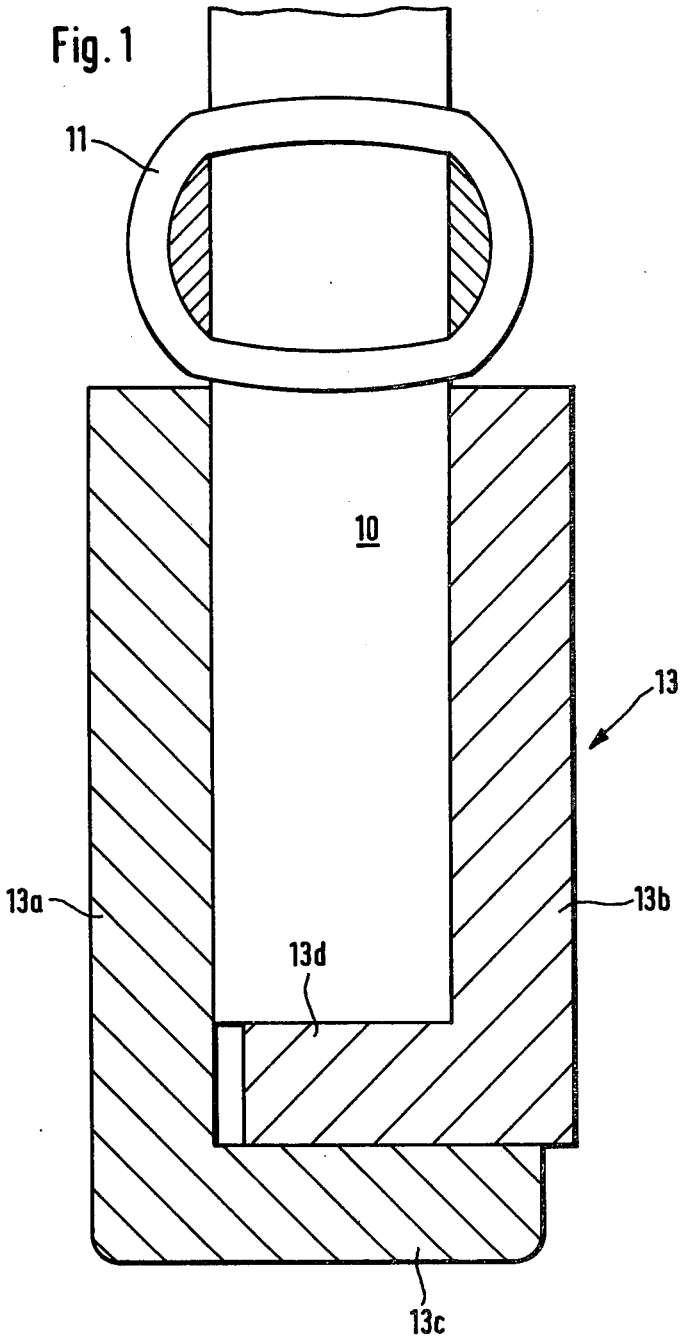
FIG. 1 is a sectional view through a connecting hull of a weaver's reed according to a first embodiment of the invention.

In the sectional views shown in FIGS. 1–5 only a lower binding hull or capsule with one ends of reed dents is illustrated and wherein a known per se screw spring is provided to define a spaced relationship between the reed dents. In all the figures the respective illustrated end of the reed dent is designated by a reference character 10 and the spring is denoted by a reference numeral 11. An insert by means of which spring 11 is coupled to the end of the reed dent is denoted by numeral 12.

Referring now to FIG. 1, it will be seen that this figure shows a cross-section through a binding hull or capsule 13 including uneven halves 13*a* and 13*b* each having an L-shaped cross-section and connected so that their outwardly projecting horizontal legs or portions 13*c* and 13*d* sealingly overlap each other in the region of the bottom of the hull 13. Therefore, a fused adhesive usually placed (not illustrated in the drawing) onto the bottom of the hull between the individual reed dents will not flow out from the hull.

Figure 2:
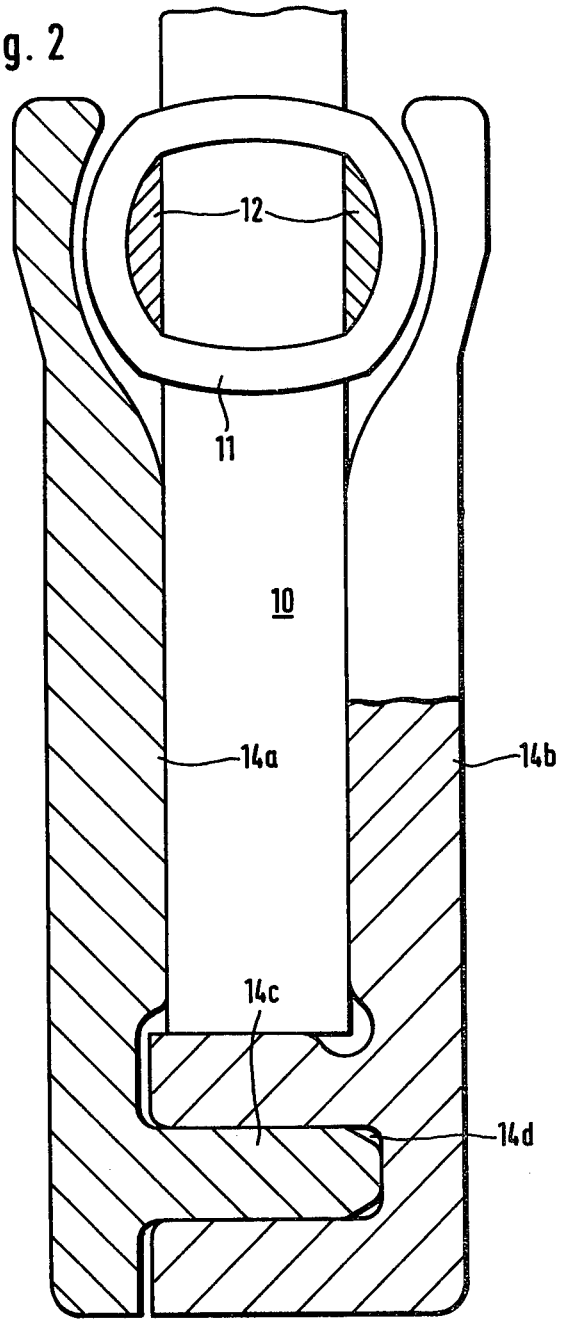
FIGS. 2 and 2*a* are sectional views through a connecting hull in accordance with another embodiment of the invention.

FIG. 2 illustrates a connecting hull 14 enclosing the end of the reed dent and including a first hull half 14*a* and a second hull half 14*b*. Hull half 14*b* is formed with a projecting bar 14*c* in the region of the bottom of the hull, which bar extends into and sealingly engages in a longitudinal groove 14*d* respectively provided in the lower region of the hull half 14*b*. The extension of the projecting bar 14*c* into longitudinal groove 14*d* corresponds to the thickness (width) of the end of the reed dent 10 so that this end is arrested in the band hull by means of an adhesive poured into the channel between halves 14*a* and 14*b*.

Figure 2A:
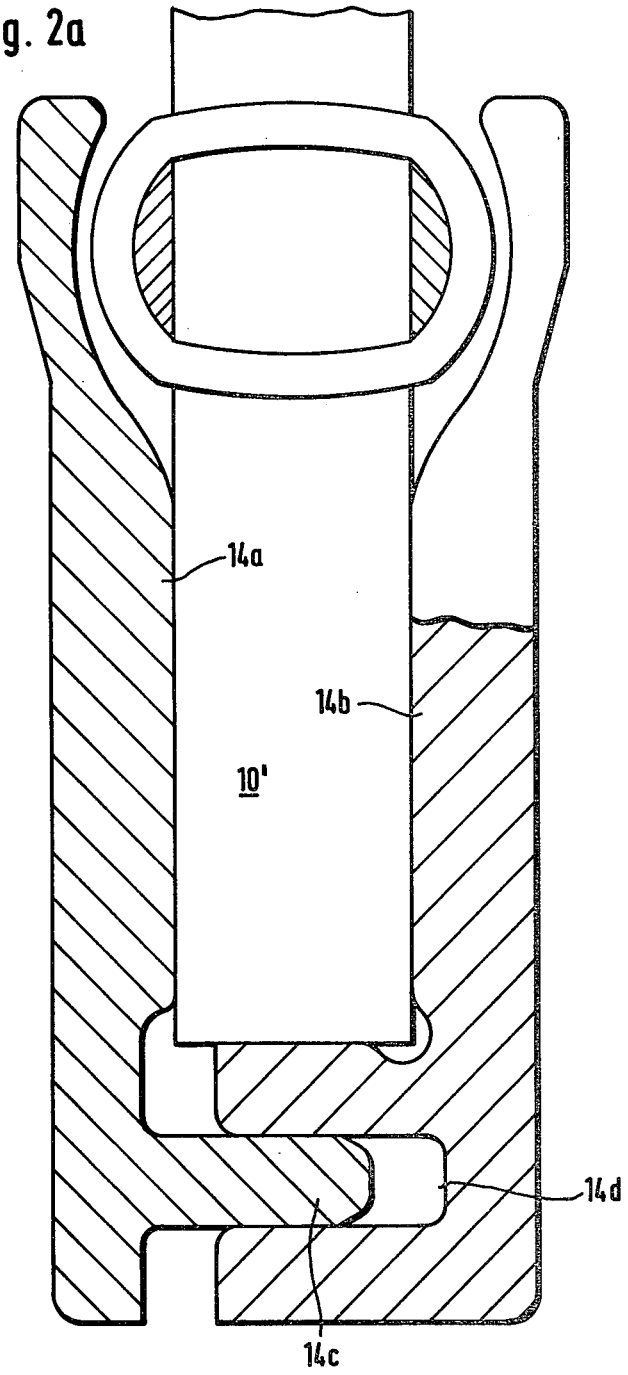

FIG. 2*a* shows a relative position of two hull halves 14*a* and 14*b* during the twisting of the reinforced (having a greater width) reed dent 10′. The structure of the both hull halves ensures here also a reliable sealing of the inner space of the hull. In contradistinction to the embodiment of FIG. 1 spring 11 in the embodiment of FIGS. 2 and 2*a* is covered by means of projections 30 made on the hull halves in a known fashion.

Figure 3:
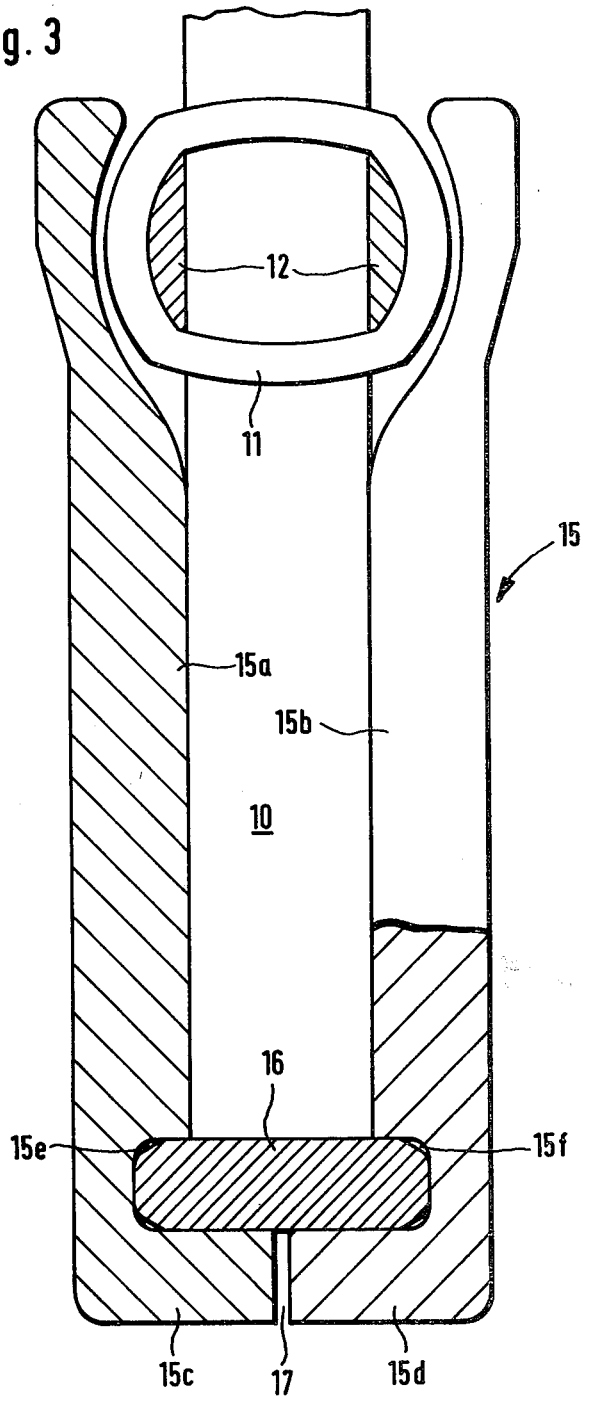
FIGS. 3 and 3*a* are sectional views through a connecting hull according to a still further embodiment of the invention.
Figure 3A:
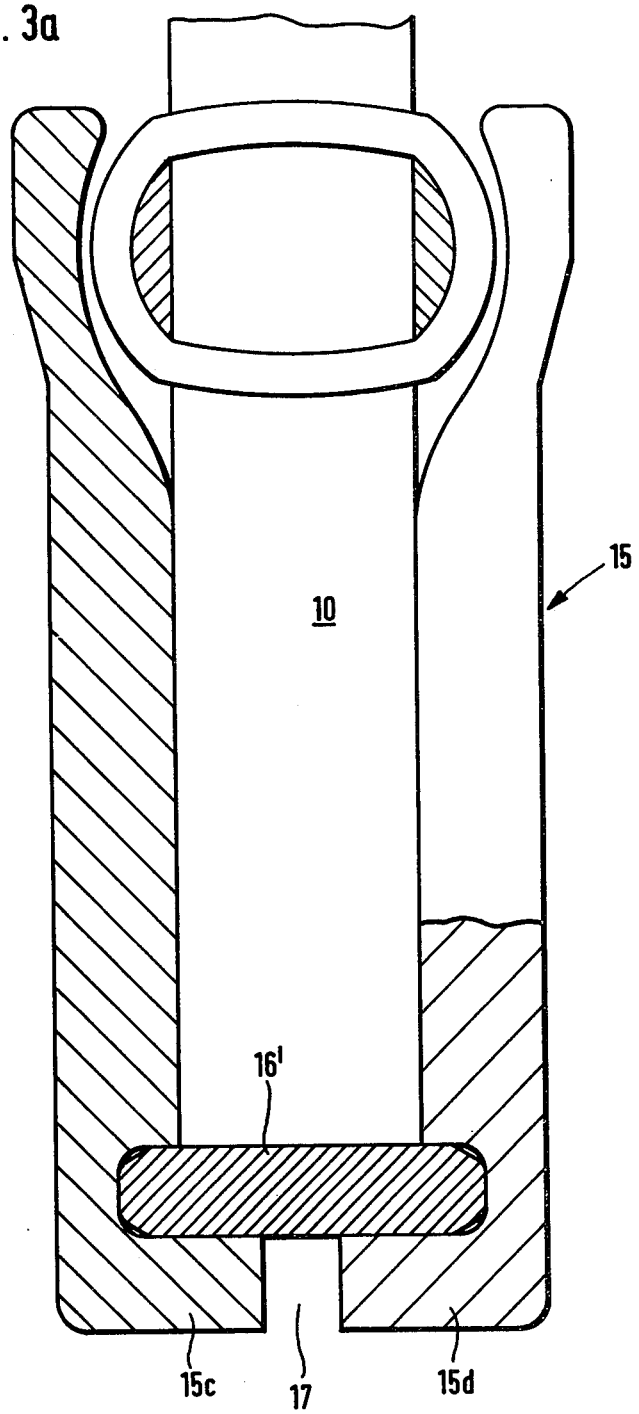

In the embodiment shown in FIGS. 3 and 3*a* the connecting hull includes two mirror-inverted halves 15*a* and 15*b*, each formed with a respective projection 15*c* or 15*d* provided in the lower area of the hull. In the assembled position of the hull projections 15*a* and 15*d* form respective grooves 15*e* and 15*f* into which a flat connection bar 16 extends with its peripheral edge. This connection bar acts as a coupling between two hull halves 15*a* and 15*b*, which coupling seals the hull in its bottom area so that no adhesive will flow out through a clearance 17 between the end faces of projections 15*c* and 15*d*.

As seen in FIG. 3*a* the hull can be adjusted to the various thicknesses of the reed dent 10 by utilizing connecting bars of different lengths.

Figure 4:
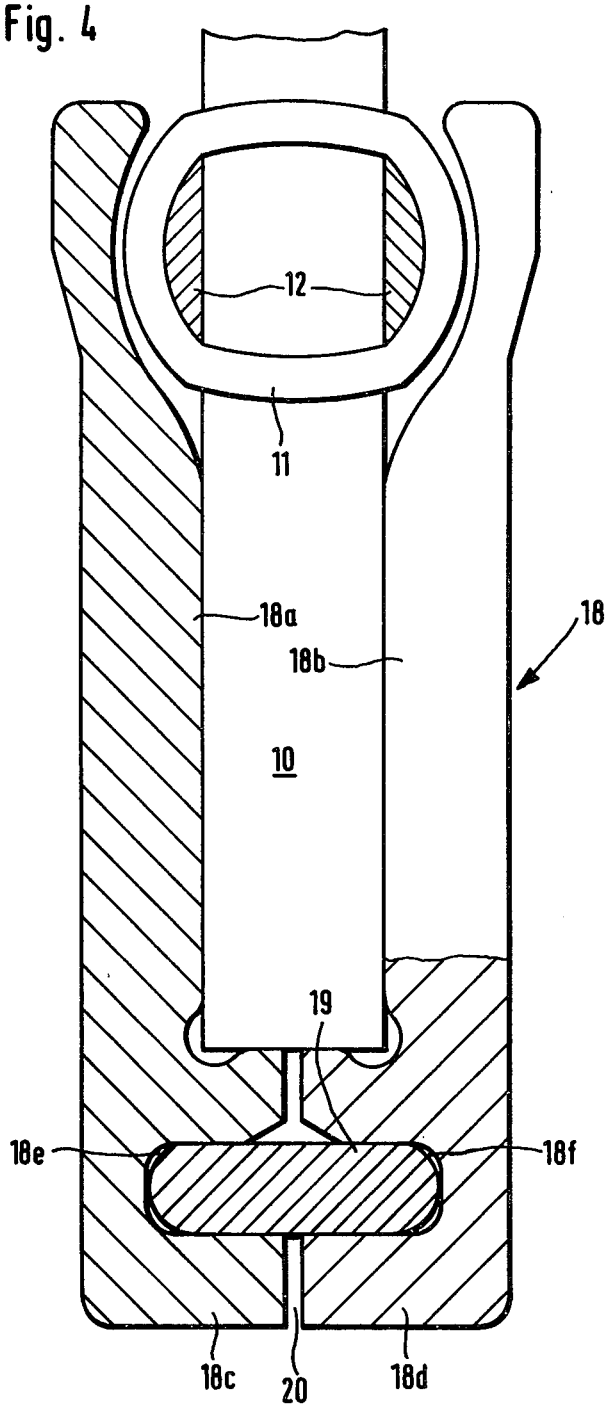
FIGS. 4 and 4*a* illustrate sectional views through a hull of still another modification of the invention.
Figure 4A:
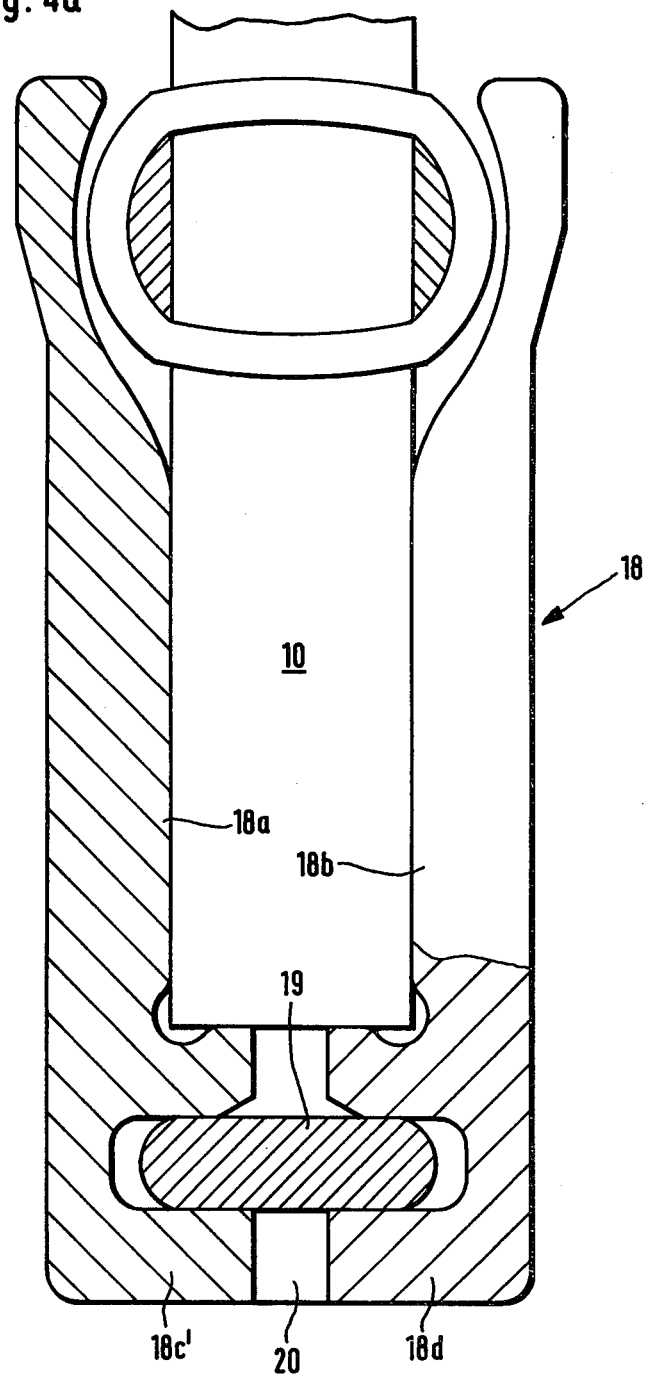

FIGS. 4 and 4*a* illustrate a further embodiment of the invention, in which grooves 18*c* and 18*d* are formed between the respective opposite projections formed in the bottom part of the hull so as to provide two opposite clearances 20 on each side of the connection bar 19. In this structure the hull may be adjusted to the various thicknesses of the reed dent 10 without requiring connection bars 19 of different widths, i.e. the same connection bar 19 can be utilized for the various reed dents. In this construction connection bar 19 acts as a sealing between projections 18*c*′ and 18*d*′ within clearance 20.

Figure 5:
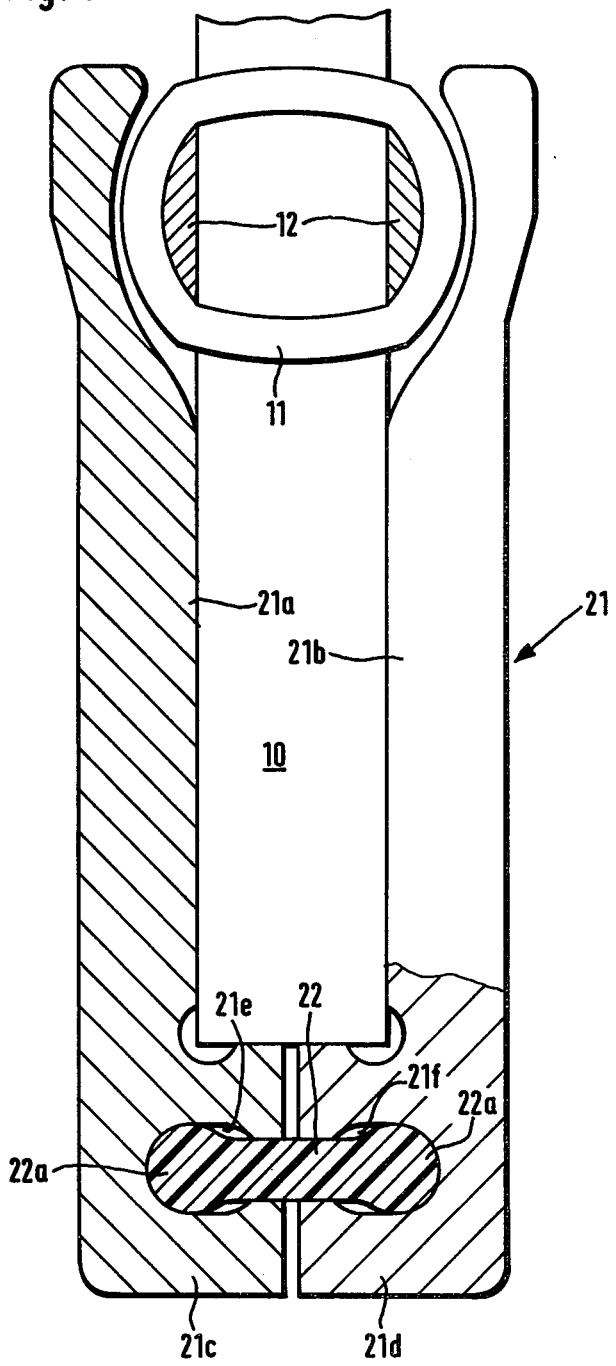
FIGS. 5 and 5*a* show sectional views through a hull in accordance with yet another embodiment of the invention.
Figure 5A:
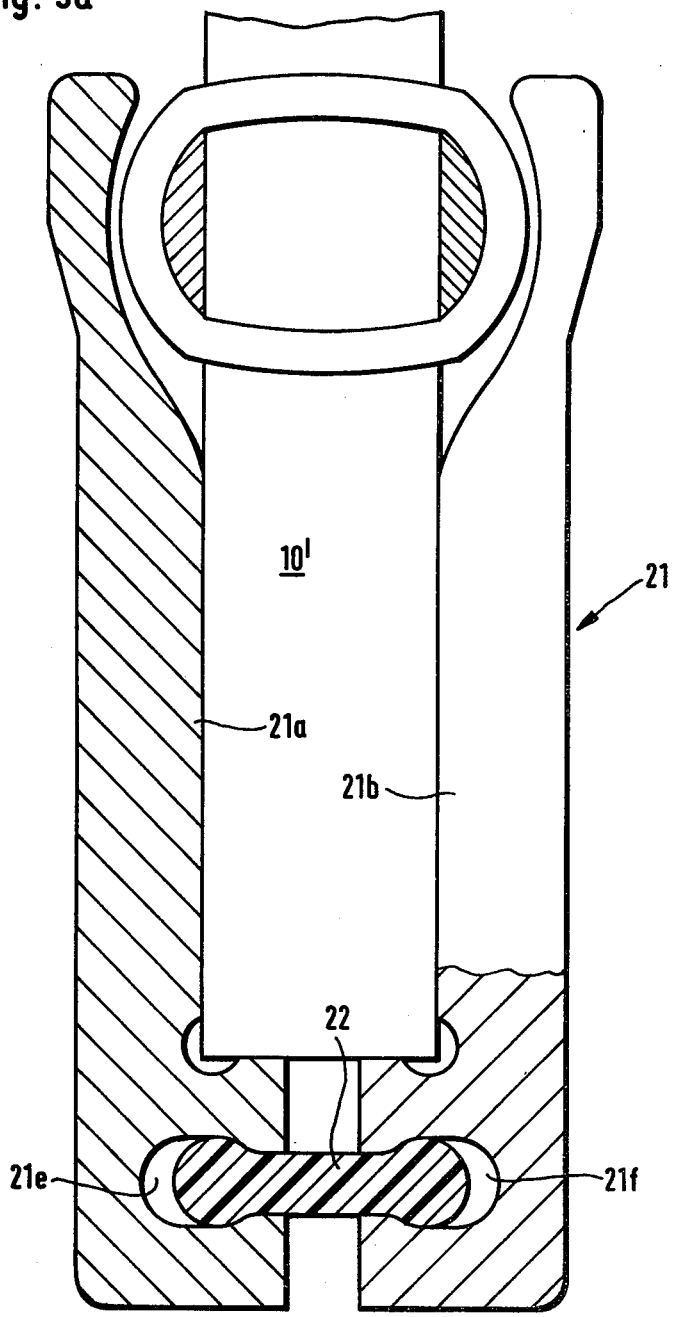

FIGS. 5 and 5*a* show an embodiment, in which the mirror-inverted halves 21*a* and 21*b* are provided analogous to those of FIGS. 3, 3*a* and 4, 4*a*.

Halves 21 and 21*b* have lower portions 21*c*, 21*d* which are formed with longitudinal grooves 21*e*, 21*f* adapted to sealingly receive a connection bar 22. In this embodiment connection bar 22 is formed of an elastic material and is provided with reinforcing beads 22*a* at the opposite edges thereof. Beads 22 in assembly engage in respective enlarged portions of grooves 21*e*, 21*f* so as to form a locking or arresting connection. Reinforcing bead-like portions 22 of connection bar 22 will slide into the grooves 21*e*, 21*f* under elastic pressures produced by insertion of the bar 22 into the grooves and then yieldingly slip into the enlarged portions of those grooves. If grooves 21*e* and 21*f* are of a greater length as shown in FIG. 5*a* adjustment of the hull may be made to a greater thickness of the reed dent 10′ with the use of the same connection bar 22.

It will be understood that each of the elements described above, or two or more together, may also find a useful application in other types of weaver's reeds, differing from the types described above.

While the invention has been illustrated and described as embodied in a reed with two parallel reed dents, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A capsule for a reed for holding parallel reed dents spaced from each other by springs, comprising two longitudinal opposite halves spaced from each other so as to form a channel receiving the ends of the reed dents therein, the ends of the reed dents being connected to each other by adhesive inserted into said capsule, each of said halves being of L-shaped cross-section and including at least one horizontally extending projection directed towards the opposite halve, the projection of one half being sealingly engaged with the projection of said other half so as to form between said projections a surface of engagement formed so as to prevent the adhesive from flowing out from the capsule.

2. The capsule as defined in claim 1, wherein the projection of one half overlaps the projection of another half.

3. The capsule as defined in claim 1, wherein one of said halves has one horizontally extending projection and another of said halves has two horizontally extending projections spaced from each other to form a recess therebetween, said one horizontally extending projection being sealingly engaged in said recess.

4. The capsule as defined in claim 1, wherein each of said projections if formed with a groove-like recess, the capsule further including a connecting element extending between said two halves and sealingly engaged in said recesses to form said surface of engagement.

5. The capsule as defined in claim 4, wherein said connecting element is formed of elastic material.

6. The capsule as defined in claim 5, wherein said connecting element is provided with two opposite enlarged end portions, said recesses being formed with respective enlarged regions, said end portions being engaged in said enlarged regions when said connecting element is inserted into said recesses.

* * * * *